United States Patent [19]

Hazewindus et al.

[11] 4,019,989

[45] Apr. 26, 1977

[54] WIEN FILTER

[75] Inventors: Nicolaas Hazewindus; Jacob Maria van Nieuwland, both of Eindhoven, Netherlands

[73] Assignee: U.S. Philips Corporation, New York, N.Y.

[22] Filed: Oct. 22, 1975

[21] Appl. No.: 624,579

[30] Foreign Application Priority Data

Nov. 25, 1974 Netherlands ..... 7415318

[52] U.S. Cl. ..... 250/396 ML; 250/396 R

[51] Int. Cl.[2] ..... H01J 39/36

[58] Field of Search ..... 250/296, 396

[56] References Cited

UNITED STATES PATENTS 3,816,748 6/1974 Harrison ..... 250/296

*Primary Examiner*—Alfred E. Smith
*Assistant Examiner*—T. N. Grigsby
*Attorney, Agent, or Firm*—Frank R. Trifari; George B. Berka

[57] ABSTRACT

A Wien filter for selecting particles having a given velocity from a beam of charged particles. Such a Wien filter comprises means to maintain an electric field and a magnetic field, which fields extend at right angles to each other and each at right angles to the axis of the particle beam. By providing a gradient in the magnetic field by means of two coils which are present on either side of the said beam and the axes of which are substantially parallel to the electric field and in which the magnetic field strengths produced in the coils are directed substantially opposite to each other, both a focus of the particle beam in a more favorable place is obtained and a stigmatic reproduction is effected so that velocity separation is considerably simplified.

5 Claims, 7 Drawing Figures

WIEN FILTER

Figure 1:
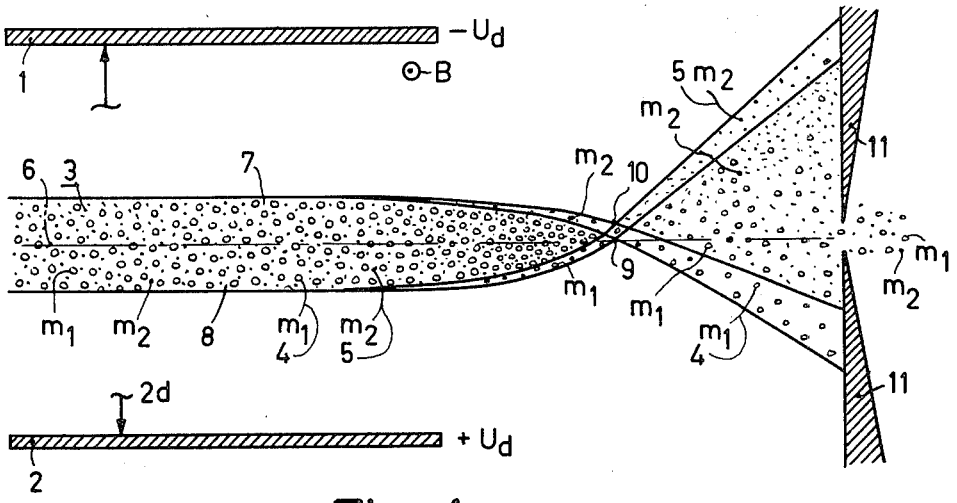

The invention relates to a Wien filter for selecting particles having a given velocity from a beam of charged particles and comprising means to maintain an electric field and a magnetic field, which fields extend substantially at right angles to each other and extend each substantially at right angles to the axis of the said beam, which magnet field is produced between the poleshoes of an electromagnet which has means to provide an adjustable gradient in the said magnetic field, said gradient being substantially parallel to the electric field.

Such a Wien filter is known from the "Handbuch der Physik", volume 33, p. 594 (corpuscular optics). As soon as the beam of charged particles enters the Wien filter, the charged particles each experience a force as a result of the said electric field and a Lorentz force. These two forces counteract each other as a result of the structure of the fields described. For a given velocity of the charged particles $v_z$ it then holds that:

$$e\,E = e\,v_z B \qquad (1)$$

in which $e$ is the charge of the charged particles $E$ is the electric field strength, $B$ is the magnetic field.

In other words, the force as a result of the electric field and the Lorentz force neutralize each other and the particles move in a straight path. For the velocity $v_z$ is also holds that:

$$v_z = (2e\,U/m)^{1/2} \qquad (2)$$

in which $m$ is the mass of the relevant particle and eU is the kinetic energy of the particle.

From this it follows that (1) is satisfied for particles having a given ratio between charge, mass and energy.

If the beam entering the Wien filter consists of particles having a given charge and energy, relation (1) will hold only for a fraction of particles having a given mass $m$, so that these are not deflected. Particles having a mass different from this mass $m$ are deflected and can be captured after passing the filter. In this manner the filter operates as a mass separator. If, however, the beam entering the Wien filter consists of particles having one given mass and charge and different energies, then it follows analogously that the Wien filter then operates as an energy separator.

Such Wien filters may be used in devices for mass analysis and structure analysis of surface layers by means of ion scattering, in ion sources for particles accelerators as mass separators and so on.

In such Wien filters it is known that the focusing of the particle beam can be influenced by a gradient in the electric or magnetic field. For providing a gradient in the electric field, a number of extra electrodes are usually used, which is rather objectionable for a number of reasons.

In the said passage from the "Handbuch der Physik" a gradient in the magnetic field is obtained by causing the poleshoes of the electromagnet to be movable. The adjustment of said magnet during its operation occurs entirely mechanically and is hence not easy.

It is an object of the invention to describe a Wien filter having a focusing which can be controlled considerably more easily by means of an adjustable gradient in the magnetic field.

Another object of the invention is to provide a Wien filter the required gradient of which can simply be calculated and which is therefore suitable for adjustment by means of a computer.

A Wien filter according to the invention and of the kind mentioned in the first paragraph is characterized in that the means producing the said gradient comprise two coils which are present on either side of the said beam and the axes of which extend substantially parallel to the electric field, the magnetic field strengths generated in the coils being directed substantially opposite to each other. Producing a magnetic field with a gradient by means of two coils is known per se (thesis by J. M. van Nieuwland, Eindhoven 1972, p. 29 et seq.) and is used in a cyclotron as an astigmatic lens after the extractor. However, the utilisation in a Wien filter is entirely novel and presents many advantages over the already known method of providing a gradient in the magnetic field of a Wien filter. Moreover, the adjustment can be carried out by controlling the electric current through the two coils and computer operation can easily be realized.

A particularly simple and cheap embodiment is that in which the said coils are wound around the poleshoes of the electromagnet.

Moreover, the electromagnet may be provided with a number of extra windings which are connected in series with the said coils but are wound in such manner that the magnetic flux produced in the extra windings is compensated for partially by the magnetic flux generated in the said coils.

If the number of A.t. (ampere turns) of the said extra windings and of each of the said coils is substantially the same, the magnetic field remains substantially constant along a line in the median plane of and in the geometric centre between the poleshoes. The advantage of this is that relation (1) remains satisfied for particles travelling along said line independently of the adjustment of the gradient in the magnetic field.

Another possibility in the Wien filter is to wind the said coils around metal cores which are arranged between the poleshoes and are provided symmetrically relative to the beamaxis. In this case the said extra windings are not necessary.

Figure 2:
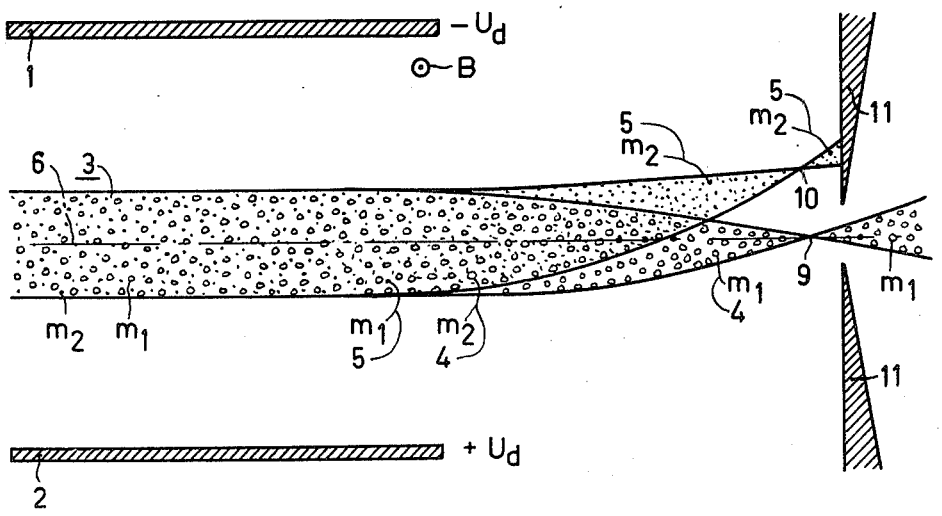
Figure 3:
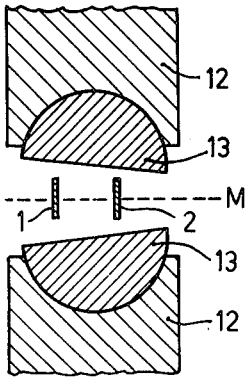
Figure 4:
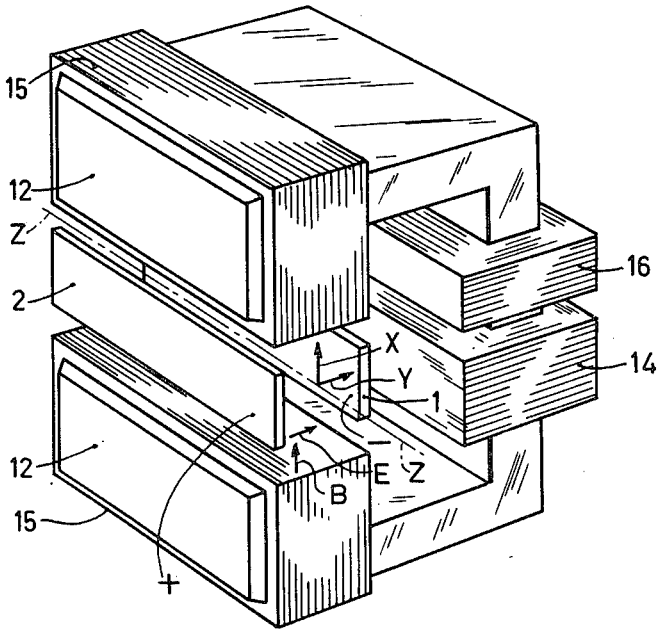
Figure 5:
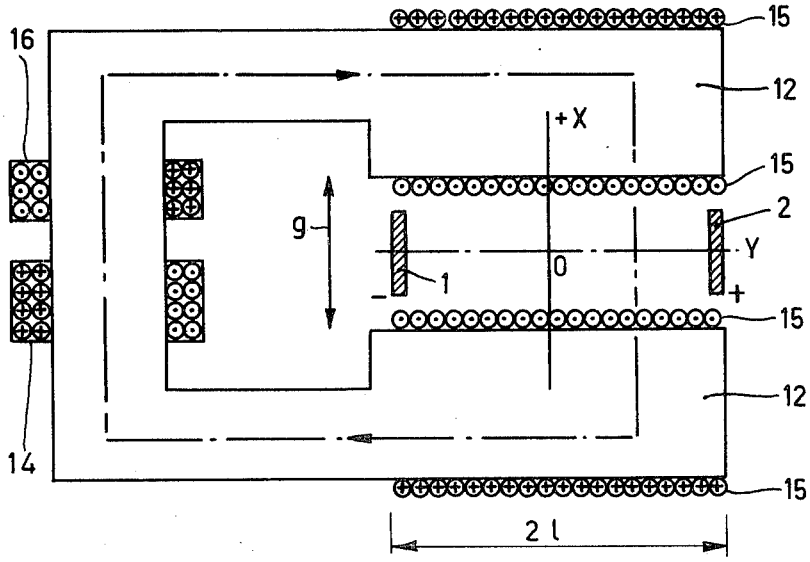
Figure 6:
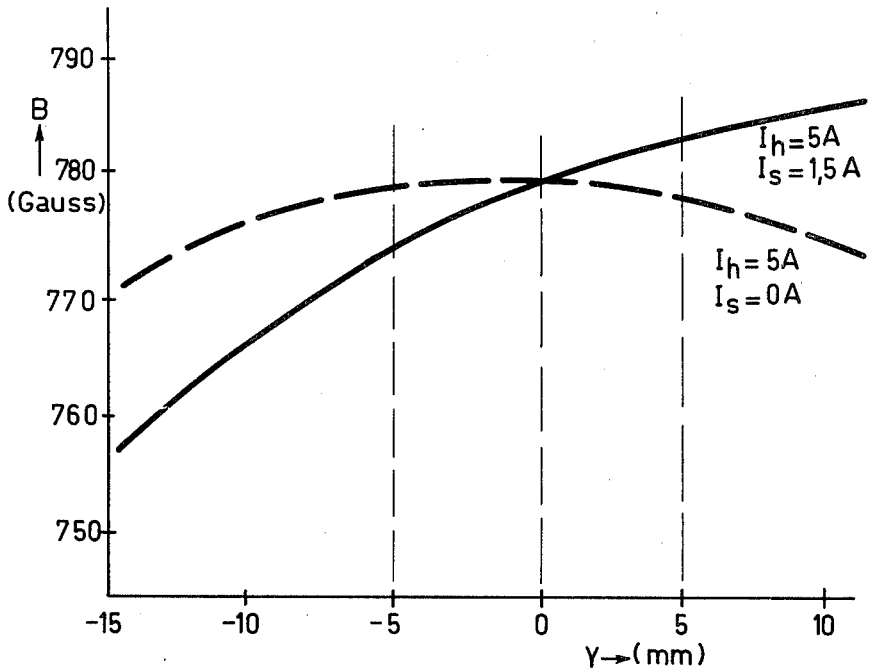
Figure 7:
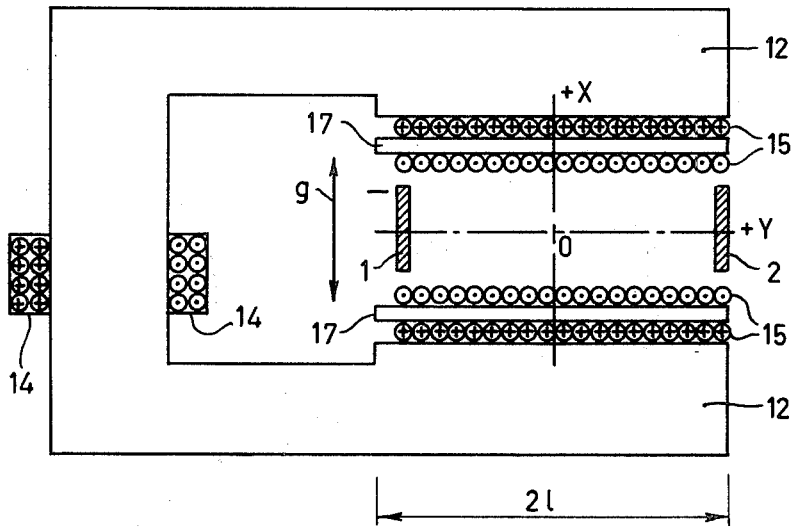

The invention will be described in greater detail with reference to a drawing, of which FIGS. 1 and 2 show the Wien filter diagrammatically, FIG. 3 shows a prior art embodiment, FIG. 4 shows an embodiment according to the invention, FIG. 5 is a sectional view taken on the line $x$–$y$ of FIG. 4, FIG. 6 shows the variation of the magnetic field in the $y$ direction, and FIG. 7 shows another embodiment according to the invention.

FIG. 1 shows diagrammatically a Wien filter. The electric field is produced between two substantially flat electrodes 1 and 2 having electric potentials of $-U_d$ and $+U_d$, respectively. The electrodes are at a distance 2 $d$ from each other. Let us consider a beam of positively charged particles 3 which, in order to avoid complexity of the drawing, consists of only two types of particles having masses $m_1$ and $m_2$ (4 and 5) with the same energy. The particles in the beam describe parallel paths. The particles of mass $m_1$ which move nearer to the electrode 1 having the potential $-U_d$ will have a larger velocity than particles of the same mass in the plane 6 present centrally between the electrodes 1 and 2 as a result of the electric boundary field when the particle beam enters the Wien filter. The particles 8 nearer to the electrode 2 thus have a lower velocity. It can easily be recognised that the larger and smaller Lorentz force as a result of the different velocities result in a forcing back of the particles 7 and 8 to the plane 6 so that a line focus 9 will be formed. Particles 5 of mass $m_2$ are deflected and have line focus 10. It will be obvious from the Figure that at the area where the beam is analysed by means of the gap 11 the separation of the masses $m_1$ and $m_2$ is not possible. Nor is it possible to provide a separation at the area of the foci 9 and 10 since for a non-truly parallel beam the foci are not punctiform and their mutual distance is small. It is known to influence the focusing by means of a gradient in the magnetic or electric field. By a gradient in the magnetic field it is ensured that the magnetic field near the electrode 1 of potential $-U_d$ is weaker than the magnetic field according to relation (1), as a result of which the repelling Lorentz force becomes smaller and the focus becomes located farther from the Wien filter as is shown in FIG. 2. Now a separation of the masses $m_1$ and $m_2$ can be effected indeed by means of the gap 11. From Maxwell's rules, however, it follows that when in the above described manner the focusing in the plane 6 is reduced, a focusing will occur in the plane at right angles to the plane 6 which forms the median plane of the poleshoes of the electromagnet in which the particles originally experienced no forces. It has now proved possible to make the focusing in the two said planes which are at right angles to each other substantially equally strong by a suitable choice of the gradient in the magnetic field. A Wien filter adjusted in this manner will reproduce a beam originally consisting of parallel moving particles, as a dot or round spot. A stigmatic reproduction hence is possible indeed. This suitable choice is possible when the gradient in the magnetic field is obtained according to the present invention. The separation of particles of different velocities as a result of mass and/or energy difference is considerably simplified by it.

FIG. 3 is a known embodiment to obtain a magnetic field having a gradient as described in the above cited "Handbuch der Physik". The poleshoes 12 have movable parts 13 in the form of semi-cylinders. Plate-shaped electrodes 1 and 2 to generate the electric field are present between the pole shoes. The mechanical adjustment of the pole shoes, however, is cumbersome and the manufacture thereof is expensive. The air gap between the various parts of the magnet also presents problems.

FIG. 4 shows an embodiment of a Wien filter according to the invention. The electromagnet consists of a mainly C-shaped magnet yoke having two poleshoes 12. The magnet yoke is manufactured from soft iron. Arranged around the magnet yoke is a coil 14 consisting of approximately 500 turns of copper wire. With a current of 5A through coil 14 a magnetic field B of approximately 780 Gauss (see also FIG. 6) is obtained which is substantially homogeneous. The electric field the strength of which follows from relations (1) is generated between the electrodes 1 and 2. According to the invention a number of turns 15 are arranged around the pole shoes forming two coils the axes of which are substantially parallel to the electric field and the magnetic fields generated in the coil are directed opposite to each other. A magnetic field having a gradient is added by the coils to the already present homogeneous magnetic field. The current through the coils is adjustable and so is the gradient. In order to be able to vary the gradient independently of the magnetic field on a line in the median plane and in the geometric centre of the poleshoes, the compensation coil 16 has been added which is connected in series with the coils on the poleshoes, the number of A.t. of the compensation coil and of each of the said coils being substantially equal.

FIG. 5 which is a sectional view taken on the $x$–$y$ plane of FIG. 4 shows the direction of the electric current through the turns of the coils 14, 15 and 16. The coils 15 and the compensation coil 16 are arranged in series while the coil 14 ensures the generation of the main magnetic field. The pole shoes are 2 l wide, while $y = 0$ is a point in the median plane and in the geometric centre between the poleshoes.

Let us consider the circuit integral of the magnetic field B along the broken line as is shown in FIG. 3.

$$\oint \frac{B_s}{\mu}\, ds = n\, I \tag{3}$$

in which $n$ I is the number of A.t. in the circuit,
$\mu$ is the magnetic permeability ($\mu_o$ in air)
$B_s$ is the component of the magnetic field in the direction of the path $s$ and
$ds$ is a line element of said path.

(Assuming $B = 0$ in the magnet yoke), then it holds for the magnetic field as a function of $y$:

$$B_{(y)} = \mu_o/g \left( NI. - MI_1 + 2\,\frac{MI_1}{2}\left(\frac{y}{l} + 1\right)\right) \tag{4}$$

$$B_{(y)} = \mu_o/g\,(\ NI. + MI_1\, y/l) \text{ for } -l \leq y \leq l \tag{5}$$

For reasons of symmetry, $B(y) = -B(y)$
NI. is the number of A.t. of coil 5
$MI_1$ is the number of A.t. of coil 6 and the coils 4 and
$g$ is the distance between the poleshoes.

From (5) it follows that the produced magnetic field consists of a constant part dependent on the coil 14 in FIG. 5;

$$B_{(y)} = \frac{\mu_o}{g}\, NI. \tag{6}$$

and superimposed hereon a field having a linear gradient:

$$B_{(y)} = \frac{\mu_o}{g}\, MI_1\, y/l \tag{7}$$

which readily corresponds to the measurements shown in FIG. 6.

FIG. 6 shows the magnetic field measured by means of a Hall Probe along the $y$-axis of FIG. 5 for two situations, namely with and without connecting the coils 15 and 16. $I_h$ is the current through coil 14 which with an intensity of approximately 5A produces a homogeneous magnetic field of a strength of approximately 780 Gausss in a region 5 mm on the left and on the right of $y = 0$. When the coils 15 and 16 are connected and the current of 1.5 A ($I_h = 5$ A and $I_s = 1.5$ A) a substantially linear gradient is formed in the magnetic field while the field in $y = 0$ remains substantially constant.

FIG. 7 shows another embodiment of the Wien filter according to the invention in which the coils 15 are wound around metal cores 17 which are arranged between the poleshoes. Analogous to what is stated with reference to FIG. 5 it follows for the magnetic field as a function of $y$:

$$B_{(y)} = \mu_{0;y} (NI_1 + MI_1 Y/1)$$

in other words again a constant field and a field having a gradient dependent on $y$. It is obvious that the turns of the coils 14 and 16 may also be provided around other parts of the magnet yoke, for example the poleshoes, without influencing the gist of the invention. The magnet yoke may also have a quite different shape, for example a shape as is often used in transformers, without departing from the scope of this invention.

What is claimed is:

1. A Wien filter for selecting particles having a given velocity from a beam of charged particles and comprising means to maintain an electric field and a magnetic field, which fields extend substantially at right angles to each other and extend each substantially at right angles of the axis of the said beam, which magnetic field is produced between the poleshoes of an electromagnet which has means to provide an adjustable gradient in the said magnetic field, said gradient being substantially parallel to the electric field, characterized in that the means producing the said gradient comprise two coils which are present on either side of the said beam and the axis of which extend substantially parallel to the electric field, the magnetic field strengths generated in the coils being directed substantially opposite to each other.

2. A Wien filter as claimed in claim 1, characterized in that the said coils are provided around the poleshoes of the electromagnet.

3. A Wien filter as claimed in claim 2, characterized in that the electromagnet has a number of extra windings which are connected in series with the said coils in such manner that the magnetic flux produced in the extra windings partly compensates for the magnetic flux produced in the coils.

4. A Wien filter as claimed in claim 3, characterized in that the number of Ampere turns (A.t.) of the said extra windings and of each of the coils is substantially the same.

5. A Wien filter as claimed in claim 1, characterized in that the coils are wound around metal cores which are arranged between the poleshoes and are provided symmetrically relative to the said beam axis.

* * * * *